US011031666B2

(12) United States Patent
Elsherbini et al.

(10) Patent No.: US 11,031,666 B2
(45) Date of Patent: Jun. 8, 2021

(54) WAVEGUIDE COMPRISING A DIELECTRIC WAVEGUIDE CORE SURROUNDED BY A CONDUCTIVE LAYER, WHERE THE CORE INCLUDES MULTIPLE SPACES VOID OF DIELECTRIC

(71) Applicant: Intel Corporation, Santa Clara, CA (US)

(72) Inventors: Adel A. Elsherbini, Chandler, AZ (US); Sasha N. Oster, Chandler, AZ (US); Georgios C. Dogiamis, Chandler, AZ (US); Telesphor Kamgaing, Chandler, AZ (US); Shawna M. Liff, Scottsdale, AZ (US); Aleksandar Aleksov, Chandler, AZ (US); Johanna M. Swan, Scottsdale, AZ (US); Brandon M. Rawlings, Chandler, AZ (US); Richard J. Dischler, Bolton, MA (US)

(73) Assignee: Intel Corporation, Santa Clara, CA (US)

( * ) Notice: Subject to any disclaimer, the term of this patent is extended or adjusted under 35 U.S.C. 154(b) by 45 days.

(21) Appl. No.: 16/325,301

(22) PCT Filed: Sep. 30, 2016

(86) PCT No.: PCT/US2016/054832
§ 371 (c)(1),
(2) Date: Feb. 13, 2019

(87) PCT Pub. No.: WO2018/063341
PCT Pub. Date: Apr. 5, 2018

(65) Prior Publication Data

US 2019/0173149 A1 Jun. 6, 2019

(51) Int. Cl.
*H01P 3/16* (2006.01)
*H01P 11/00* (2006.01)
(Continued)

(52) U.S. Cl.
CPC ..... *H01P 3/16* (2013.01); *H01P 3/122* (2013.01); *H01P 3/127* (2013.01); *H01P 11/002* (2013.01); *H01P 11/006* (2013.01)

(58) Field of Classification Search
CPC ..... H01P 3/16; H01P 3/122; H01P 11/006; H01P 1/042; H01P 5/02
(Continued)

(56) References Cited

U.S. PATENT DOCUMENTS 3,275,956 A * 9/1966 Prache ..... H01P 1/16 333/242
4,525,693 A * 6/1985 Suzuki et al. ..... H01P 3/16 156/184
(Continued)

FOREIGN PATENT DOCUMENTS

WO WO-2018063341 A1 4/2018

OTHER PUBLICATIONS

"International Application Serial No. PCT/US2016/054832, International Search Report dated Apr. 25, 2017", 3 pgs.
(Continued)

*Primary Examiner* — Benny T Lee
(74) *Attorney, Agent, or Firm* — Schwegman Lundberg & Woessner, P.A.

(57) ABSTRACT

An apparatus comprises a waveguide including: an elongate waveguide core including a dielectric material, wherein the waveguide core includes at least one space arranged lengthwise along the waveguide core that is void of the dielectric material; and a conductive layer arranged around the waveguide core.

13 Claims, 5 Drawing Sheets

(51) Int. Cl.
*H01P 3/12* (2006.01)
*H01P 3/127* (2006.01)

(58) Field of Classification Search
USPC ..... 333/239, 248, 24 R
See application file for complete search history.

(56) References Cited

U.S. PATENT DOCUMENTS

| | | | | |
|---|---|---|---|---|
| 5,363,464 | A | 11/1994 | Way et al. | |
| 10,270,145 | B1 * | 4/2019 | Antipov et al. | H01P 3/16 |
| 2005/0099242 | A1 | 5/2005 | Sano | |
| 2008/0036558 | A1 | 2/2008 | Suarez-Gartner | |
| 2014/0240187 | A1 | 8/2014 | Herbsommer et al. | |
| 2014/0368301 | A1 | 12/2014 | Herbsommer et al. | |
| 2017/0040659 | A1 * | 2/2017 | Morgan et al. | H01P 3/16 |

OTHER PUBLICATIONS

"International Application Serial No. PCT/US2016/054832, Written Opinion dated Apr. 25, 2017", 7 pgs.
"International Application Serial No. PCT US2016 054832, International Preliminary Report on Patentability dated Apr. 11, 2019", 9 pgs.

* cited by examiner

WAVEGUIDE COMPRISING A DIELECTRIC WAVEGUIDE CORE SURROUNDED BY A CONDUCTIVE LAYER, WHERE THE CORE INCLUDES MULTIPLE SPACES VOID OF DIELECTRIC

CLAIM OF PRIORITY

This patent application is a U.S. National Stage Application under 35 U.S.C. 371 from International Application No. PCT/US2016/054832, filed Sep. 30, 2016, published as WO2018/063341, which is incorporated herein by reference.

TECHNICAL FIELD

Embodiments pertain to high speed interconnections in electronic systems, and more specifically to waveguides for implementing communication interfaces between electronic devices.

BACKGROUND

As more electronic devices become interconnected and users consume more data, the demand on server system performance continues to increase. More and more data is being stored in internet "clouds" remote from devices that use the data. Clouds are implemented using servers arranged in server clusters (sometimes referred to as server farms). The increased demand for performance and capacity has led server system designers to look for ways to increase data rates and increase the server interconnect distance in switching architectures while keeping power consumption and system cost manageable.

Within server systems and within high performance computing architectures there can be multiple levels of interconnect between electronic devices. These levels can include within blade interconnect, within rack interconnect, rack-to-rack interconnect and rack-to-switch interconnect. Shorter interconnect (e.g., within rack interconnect and some rack-to-rack_interconnect) is traditionally implemented with electrical cables (e.g., Ethernet cables, co-axial cables, twin-axial cables, etc.) depending on the required data rate. For longer distances, optical cables are sometimes used because fiber optic solutions offer high bandwidth for longer interconnect distances.

However, as high performance architectures emerge (e.g., 100 Gigabit Ethernet), traditional electrical approaches to device interconnections that support the required data rates are becoming increasingly expensive and power hungry. For example, to extend the reach of an electrical cable or extend the bandwidth of an electrical cable, higher quality cables may need to be developed, or advanced techniques of one or more of equalization, modulation, and data correction may be employed which increases power of the system and adds latency to the communication link. For some desired data rates and interconnect distances, there is presently not a viable solution. Optical transmission over optical fiber offers a solution, but at a severe penalty in power and cost. The present inventors have recognized a need for improvements in the interconnection between electronic devices.

DETAILED DESCRIPTION OF THE INVENTION

The following description and the drawings sufficiently illustrate specific embodiments to enable those skilled in the art to practice them. Other embodiments may incorporate structural, logical, electrical, process, and other changes. Portions and features of some embodiments may be included in, or substituted for, those of other embodiments. Embodiments set forth in the claims encompass all available equivalents of those claims.

Traditional electrical cabling may not meet the emerging requirements for electronic systems such as server clusters. Fiber optics may meet the performance requirements, but may result in a solution that is too costly and power hungry.

Figure 1:
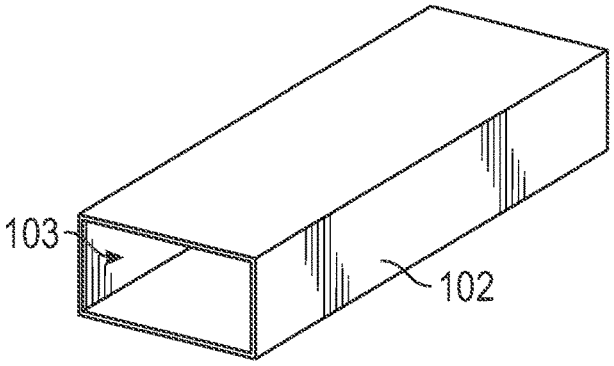
FIG. 1 is an illustration of a waveguide in accordance with some embodiments.

FIG. 1 is an illustration of an embodiment of a waveguide. The waveguide includes an outer layer of conductive material 102 such as metal. The inside of the waveguide can be hollow and air filled or can include a dielectric material 103. A waveguide can be used to propagate electromagnetic waves having a wavelength in millimeters (mm) or micrometers (μm). Electromagnetic waves travel along the length of the waveguide. A transceiver and an antenna (sometimes referred to as a "waveguide launcher") can be used to send electromagnetic waves along the waveguide from the transmitting end. A transceiver at the receiving end can receive the propagated signals using a receiving antenna. Waveguides offer the bandwidth needed to meet the emerging requirements.

However, a waveguide that only includes a conductive layer and an empty center can be difficult to work with as such waveguides can be prone to buckling or kinking when bending the waveguide or trying to apply the waveguide to a physical connector. A waveguide that includes a conductive layer around a solid waveguide core of a standard dielectric material (as in the example of FIG. 1) can exhibit significant losses if the operating frequency of the waveguide is 100 gigahertz (GHz) or higher. To reduce the losses, very low loss dielectric materials can be used, but these materials can be relatively expensive and can also present challenges in manufacturing that lead to higher cost. Additionally, some very low loss dielectric materials are ceramic-based or ceramic-compound based and may not have the desired flexibility for the waveguide application.

Figure 2:
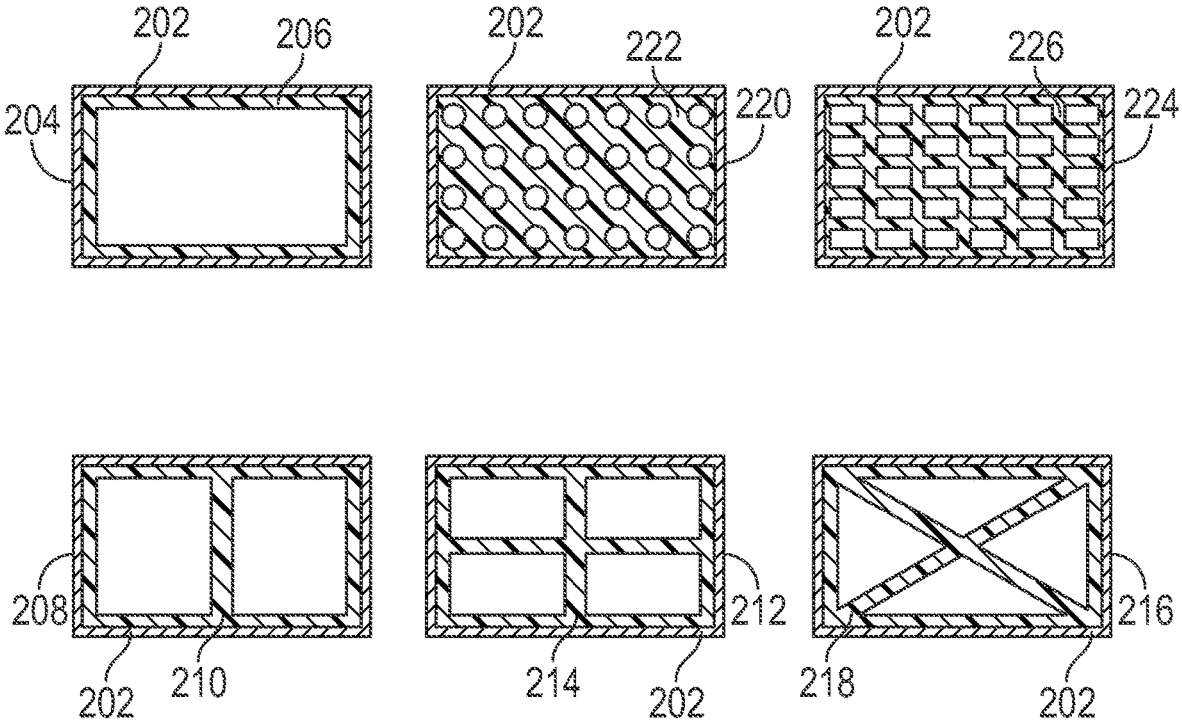
FIG. 2 illustrates cross sections of waveguides in accordance with some embodiments.

FIG. 2 are illustrations of examples of cross sections of waveguides. The cross sections may have a height of 0.5-1.0 mm and a width of 1-2 mm. The waveguides are elongate and may have a length of one to five meters (1-5 m). In certain embodiments, the waveguides are dimensioned to carry signals having frequencies of 30 Gigahertz (GHz) to 300 GHz. In certain embodiments, the waveguides are dimensioned to carry signals having frequencies of 100 GHz to 900 GHz. The example cross sections in the Figure are rectangular, but the cross section may be circular, elliptical, square, or another more complex geometry. Each of the waveguides includes an elongate waveguide core of dielectric material and a conductive layer 202 arranged around the waveguide core. Each of the waveguide cores includes at least one space arranged lengthwise within the waveguide core that is void of the dielectric material.

Waveguide 204 includes a waveguide core of the dielectric material in the shape of a hollow tube 206. The waveguide core includes a single space void of the dielectric material. In certain embodiments the waveguide core is formed using one or more of polyethylene (PE), polytetrafluoroethylene (PTFE), perfluoroalkoxy alkanes (PFA), fluorinated ethylene propylene (FEP), polyvinylidene fluoride (PVDF), liquid crystal polymer (LCP), or ethylene-tetraflouroethylene (ETFE). The dielectric waveguide core may be formed using a drawing process that draws a continuous tube from a source material. In certain embodiments, the waveguide is formed using an extrusion process. A conductive layer 202 may then be arranged around the waveguide core. The conductive layer 202 may be on the outside of the waveguide or protected by another dielectric layer. The latter case is shown in the example in FIG. 2. In certain examples, the conductive layer includes metal, such as one or more of copper, gold, silver, and aluminum.

Waveguide 208 includes a waveguide core formed of the dielectric material in the shape of an I-beam 210 arranged lengthwise along the waveguide core. The waveguide core includes two spaces in the dielectric material running parallel through the waveguide. The waveguide core may be formed by injection molding and the conductive layer arranged around the formed dielectric waveguide core. The I-beam shape can provide structural support for the waveguide making it easier to physically install without buckling or kinking.

Waveguides 212 and 216 each include a waveguide core formed of the dielectric material in the shape of a cross beam 214 and 218, respectively, arranged lengthwise along the waveguide core. Each waveguide cores includes four spaces in the dielectric material running parallel through the waveguide. Like the I-beam shaped waveguide core, a cross beam shaped waveguide core may also provide structural support to the waveguide.

Waveguides 220 and 224 each include spaces arranged lengthwise through the wave guide in parallel to each other and arranged in a regular pattern to form a lattice cross section of the elongate waveguide core. In waveguide 220 the spaces 222 form circular openings in the cross section of the waveguide, and in waveguide 224 the spaces 226 form rectangular openings in the cross section of the waveguide. Like the I-beam and cross beam versions, the lattice cross sections may provide structural support for the waveguide. The waveguide core examples that have multiple spaces (waveguides 208, 212, 216, 220, and 224) can be formed using injection molding and covered with the conductive layer. The waveguide core may be continuous through the waveguides with the cross section shape continuous through the core, or the wave guide may include sections along the length that are void of the dielectric material In the waveguide examples of FIG. 2, the feature dimensions in the cross sections are much smaller than the wavelength of the electromagnetic waves that will travel along the length of the waveguide. The result is that the effective permittivity and the effective loss tangent are between those of a waveguide with an empty or air-filled center, and a waveguide with a waveguide core that is a solid dielectric. In some embodiments, the dielectric material of the waveguide cores in FIG. 2 comprises twenty percent (20%) or less of a cross section of the elongate waveguide core and the space void of dielectric material comprises eighty percent (80%) or more of the cross section of the elongate waveguide core.

Figure 7:
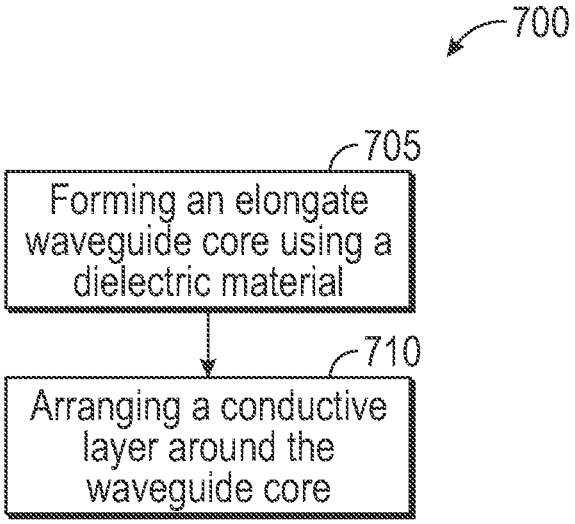
FIG. 7 is a flow diagram of an embodiment of making a waveguide in accordance with some embodiments.

FIG. 7 is a flow diagram of a method 700 of making a waveguide. At step 705, an elongate waveguide core is formed using a dielectric material. The waveguide core can include one or more spaces arranged lengthwise along the waveguide core that is void of the dielectric material. The spaces can be tubes formed in the dielectric material and the tubes may have any of the cross sections shown in the embodiments of FIG. 2.

At step 710, a conductive layer is arranged around the waveguide core. Different methods can be used to form the conductive layer over a waveguide core. If the conductive layer is a metal layer, the conductive layer may be sputtered onto the waveguide core. In some embodiments, a sleeve of conductive material is arranged over the waveguide core. The conductive may be heat-shrinkable and the sleeve may be shrink wrapped over the waveguide core (e.g., using a thermal treatment) to form a conductive layer over waveguide core. According to some embodiments, the conductive layer of the waveguide can be formed by applying a liquid or paste that includes a conductive material (e.g., a conductive polymer or a metal) to the outside surface of the waveguide core. A conductive liquid can be sprayed onto the waveguide core, or the waveguide core can be immersed into a container of the conductive liquid. A conductive paste can be brushed onto the waveguide core. The waveguide core may be dried or heated at different stages. In certain embodiments, sintering steps may be provided at different stages of coatings. In some variations, sintering can involve a laser or photonic sintering process if the dielectric material of the waveguide core is sensitive to thermal sintering temperatures.

Figure 3:
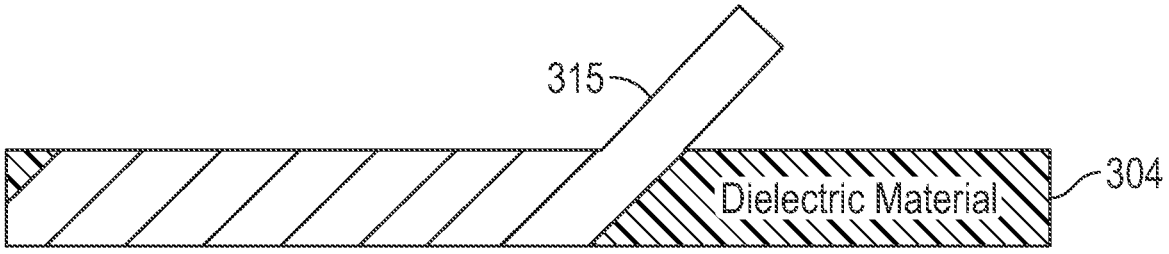
FIG. 3 is an illustration of a method of forming a conductive layer of a waveguide in accordance with some embodiments.

FIG. 3 is an illustration of another embodiment of forming the conductive layer of a waveguide. Tape 315 or ribbon made of a conductive material is wrapped around the outside surface of a dielectric material waveguide core 304 to form the conductive sheet around the core. In some embodiments, the tape includes metal and the tape can be a foil ribbon. The metallic tape can include one or more of copper, gold, silver, and aluminum. In some embodiments, the tape includes a conductive polymer, such as a polyaniline (PANI), poly(3, 4-ethylenedioxythiophene) polystyrene sulfonate (PEDOT: PSS), or polyethylene terephthalate (PET) for example. The conductive tape wrapped around the waveguide core material may include an adhesive on at least one surface of the conductive tape to provide good adhesion to the waveguide and to the tape itself. The adhesive layer can be very thin (e.g., down to a monolayer of the adhesive material) to minimize impact on the waveguide performance.

Which approach (sputtering, sleeve, spraying, brushing, wound tape, etc.) is used to form the waveguide conductive sheet may depend on the geometry of the waveguide core. If the waveguide core has a cross section with smooth corners (e.g., a circle or oval) the tape-winding method may be used. If the waveguide core has a cross section that includes corners (e.g., a rectangle or square) the shrink-wrapped approach may be more desirable due to susceptibility of the tape to tearing.

Figure 4:
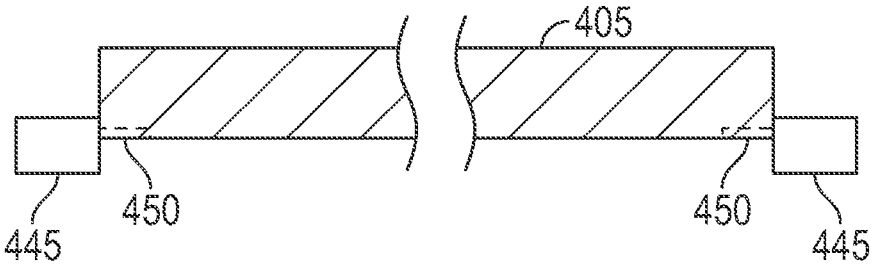
FIG. 4 is an illustration of another embodiment of a waveguide in accordance with some embodiments.

FIG. 4 is an illustration of another embodiment of a waveguide. The waveguide 405 includes a layer of conductive tape wound around a waveguide core. The ends of the waveguide can be operatively connected to transceiver circuits 445 and antennas 450 or waveguide launchers (e.g., patch antennas). The waveguide link can be used in establishing communication among servers in a server cluster or server farm.

Figure 5:
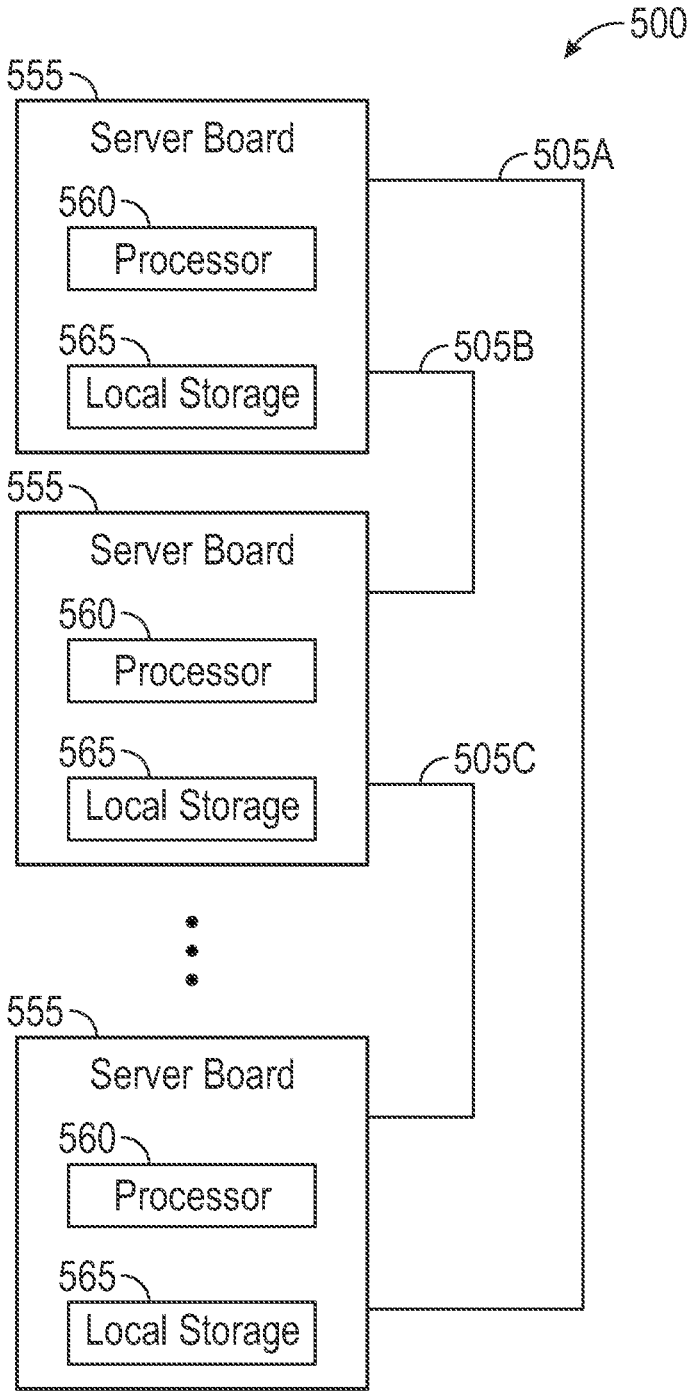
FIG. 5 is a block diagram of an electronic system in accordance with some embodiments.

FIG. 5 is a block diagram of an electronic system 500 incorporating waveguide assemblies in accordance with at least one embodiment of the invention. Electronic system 500 is merely one example in which embodiments of the present invention can be used. The electronic system 500 of FIG. 5 comprises multiple servers or server boards 555 interconnected as a server cluster that may provide internet cloud services. A server board 555 may include one or more processors 560 and local storage 565. Only three server boards are shown to simplify the example in the Figure. A server cluster may include hundreds of servers arranged on boards or server blades in a rack of servers, and a server cluster can include dozens of racks of server blades. Racks can be placed side-by-side with a back-plane or back-panel used to interconnect the racks. Server switching devices can be included in the racks of the server cluster to facilitate switching among the hundreds of servers.

Figure 6:
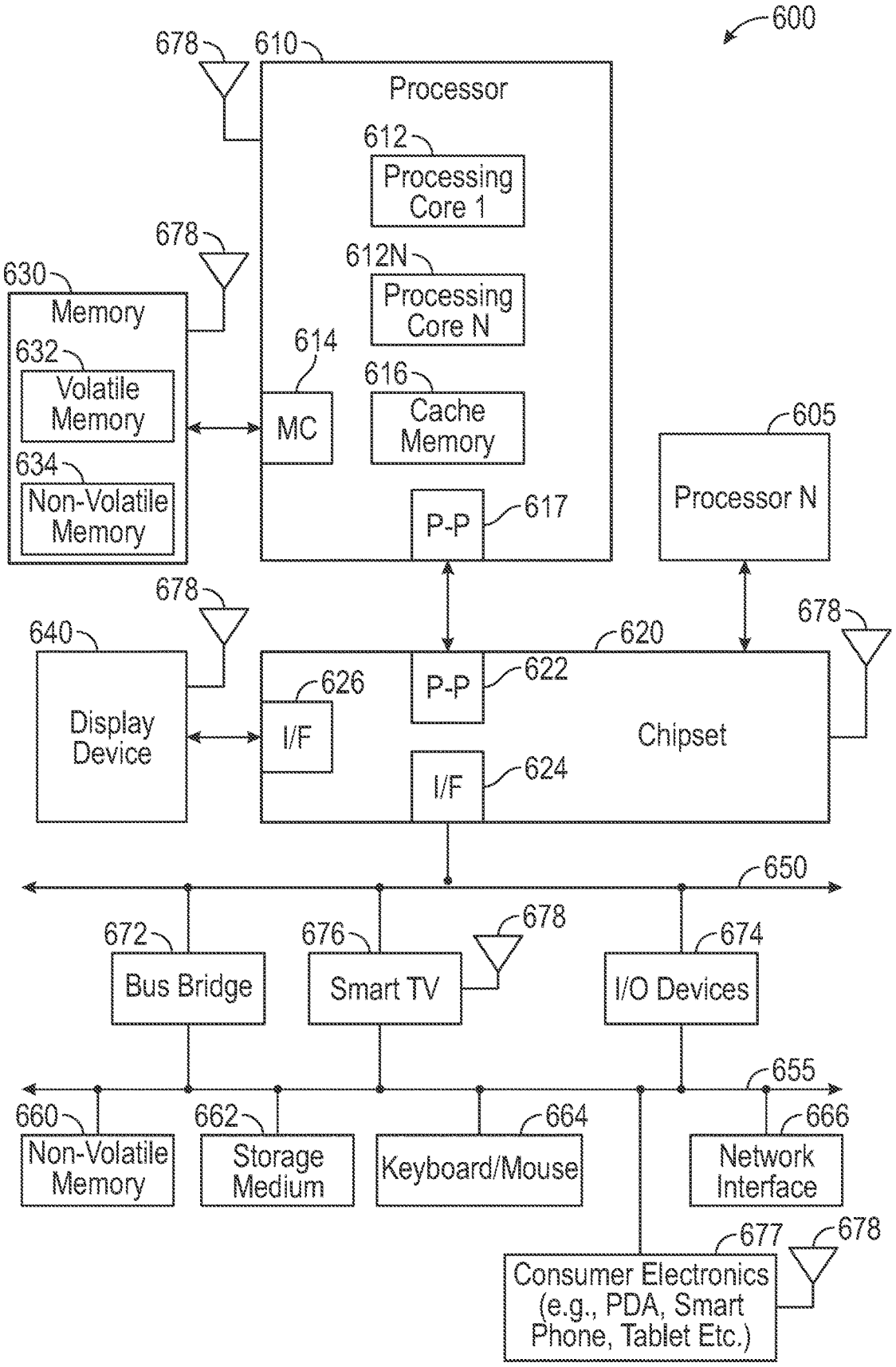
FIG. 6 is an illustration of another embodiment of a waveguide in accordance with some embodiments.

The server boards in FIG. 5 are shown interconnected using waveguides 505A, 505B, and 505C, although an actual system would include hundreds of rack-to-rack and within rack interconnections. The waveguides are operatively connected to ports of the servers. There can be multiple levels of interconnect between servers. These levels can include within server blade interconnect, within server rack interconnect, rack-to-rack interconnect and rack-to-switch interconnect. The waveguides 505A, 505B, and 505C are used for at least a portion of the interconnect within the server system, and can be used for any of the within server blade, within server rack, rack-to-rack, and rack-to-switch interconnections. In certain embodiments, the waveguides form at least a portion of back-panel interconnections for a server cluster. FIG. 6 illustrates a system level diagram, according to one embodiment of the invention. For instance, FIG. 6 depicts an example of an electronic device (e.g., system) that can include the waveguide interconnections as described in the present disclosure. FIG. 6 is included to show an example of a higher level device application for the present, invention. In one embodiment, system 600 includes, but is not limited to, a desktop computer, a laptop computer, a netbook, a tablet, a notebook computer, a personal digital assistant (PDA), a server, a workstation, a cellular telephone, a mobile computing device, a smart phone, an Internet appliance or any other type of computing device. In some embodiments, system 600 is a system on a chip (SOC) system. In one example two or more systems, as shown in FIG. 6 may be coupled together using one or more waveguides as described in the present disclosure. In one specific example, one or more waveguides as described in the present disclosure may implement one or more of busses 650 and 655.

In one embodiment, processor 610 has one or more processing cores including processor core 1 612 and processor core N 612N, where 612N represents the Nth processor core inside processor 610 where N is a positive integer. In one embodiment, system 600 includes multiple processors including processor 610 and processor N 605, where processor N 605 has logic similar or identical to the logic of processor 610. In some embodiments, processing core 612 includes, but is not limited to, pre-fetch logic to fetch instructions, decode logic to decode the instructions, execution logic to execute instructions and the like. In some embodiments, processor 610 has a cache memory 616 to cache instructions and/or data for system 600. Cache memory 616 may be organized into a hierarchal structure including one or more levels of cache memory In some embodiments, processor 610 includes a memory controller 614(MC), which is operable to perform functions that enable the processor 610 to access and communicate with memory 630 that includes a volatile memory 632 and/or a non-volatile memory 634. In some embodiments, processor 610 is coupled with memory 630 and chipset 620. Processor 610 may also be coupled to a wireless antenna 678 to communicate with any device configured to transmit and/or receive wireless signals. In one embodiment, the wireless antenna interface 678 operates in accordance with, but is not limited to, the IEEE 802.11 standard and its related family, Home Plug AV (HPAV), Ultra Wide Band (UWB), Bluetooth, WiMax, or any form of wireless communication protocol.

In some embodiments, volatile memory 632 includes, but is not limited to, Synchronous Dynamic Random Access Memory (SDRAM), Dynamic Random Access Memory (DRAM), RAMBUS Dynamic Random Access Memory (RDRAM), and/or any other type of random access memory device. Non-volatile memory 634 includes, but is not limited to, flash memory, phase change memory (PCM), read-only memory (ROM), electrically erasable programmable read-only memory (EEPROM), or any other type of non-volatile memory device.

Memory 630 stores information and instructions to be executed by processor 610. In one embodiment, memory 630 may also store temporary variables or other intermediate information while processor 610 is executing instructions. In the illustrated embodiment, chipset 620 connects with processor 610 via Point-to-Point (PtP or P-P) interfaces P-P 617 and P-P 622. Chipset 620 enables processor 610 to connect to other elements in system 600. In some embodiments of the invention, interfaces 617 and 622 operate in accordance with a PtP communication protocol such as the Intel® QuickPath Interconnect (QPI) or the like. In other embodiments, a different interconnect may be used.

In some embodiments, chipset 620 is operable to communicate with processor 610, processor N 605, display device 640, and other devices 672, 676, 674, 660, 662, 664, 666, 677, etc. Buses 650 and 655 may be interconnected together via a bus bridge 672. Chipset 620 connects to one or more buses 650 and 655 that interconnect various elements 674, 660, 662, 664, and 666. Chipset 620 may also be coupled to a wireless antenna 678 to communicate with any device configured to transmit and/or receive wireless signals. Chipset 620 connects to display device 640 via interface 626 (I/F). Display 640 may be, for example, a liquid crystal display (LCD), a plasma display, cathode ray tube (CRT) display, or any other form of visual display device. In some embodiments of the invention, processor 610 and chipset 620 are merged into a single SOC. In one embodiment, chipset 620 couples with a non-volatile memory 660, a mass storage medium 662, a keyboard/mouse 664, and a network interface 666 via interface 624 (I/F), I/O device(s) 674, smart TV 676, and consumer electronics 677 (e.g., PDA, smart phone, tablet, etc.).

In one embodiment, mass storage device 662 includes, but is not limited to, a solid state drive, a hard disk drive, a universal serial bus flash memory drive, or any other form of computer data storage medium. In one embodiment, network interface 666 is implemented by any type of well known network interface standard including, but not limited to, an Ethernet interface, a universal serial bus (USB) interface, a Peripheral Component Interconnect (PCI) Express interface, a wireless interface and/or any other suitable type of interface. In one embodiment, the wireless interface operates in accordance with, but is not limited to, the IEEE 802.11 standard and its related family, Home Plug AV (HPAV), Ultra Wide Band (UWB), Bluetooth, WiMax, or any form of wireless communication protocol.

While the modules shown in FIG. 6 are depicted as separate blocks within the system 600, the functions performed by some of these blocks may be integrated within a single semiconductor circuit or may be implemented using two or more separate integrated circuits. For example, although cache memory 616 is depicted as a separate block within processor 610, cache memory 616 (or selected aspects of 616) can be incorporated into processor core 612.

ADDITIONAL DESCRIPTION AND EXAMPLES

Example 1 can include subject matter (such as an apparatus) comprising a waveguide including: an elongate waveguide core including a dielectric material, wherein the waveguide core includes at least one space arranged lengthwise within the waveguide core that is void of the dielectric material; and a conductive layer arranged around the waveguide core.

In Example 2, the subject matter of Example 1 optionally includes an elongate waveguide core that is a hollow tube of dielectric material and includes a single space that is void of the dielectric material.

In Example 3, the subject matter of one or both of Examples 1 and 2 optionally includes an elongate waveguide core including multiple spaces arranged lengthwise through the waveguide core that are void of the dielectric material.

In Example 4, the subject matter of Example 3 optionally includes the multiple spaces arranged lengthwise through the wave guide core being arranged in a regular pattern to form a lattice cross section of the elongate waveguide core.

In Example 5, the subject matter of one or any combination of Examples 1-3 optionally includes an elongate waveguide core includes a cross beam formed of the dielectric material arranged lengthwise along the waveguide core.

In Example 6, the subject matter of one or any combination of Examples 1-3 optionally includes an elongate waveguide core includes an I-beam formed of the dielectric material arranged lengthwise along the waveguide core.

In Example 7, the subject matter of one or any combination of Examples 1-6 optionally includes the dielectric material comprising twenty percent (20%) or less of a cross section of the elongate waveguide core and space void of dielectric material comprises eighty percent (80%) or more of the cross section of the elongate waveguide core.

In Example 8, the subject matter of one or any combination of Examples 1-7 optionally includes a dielectric material including at least one of polyethylene (PE), polytetrafluoroethylene (PTFE), perfluoroalkoxy alkanes (PFA), fluorinated ethylene propylene (FEP), polyvinylidene fluoride (PVDF), liquid crystal polymer (LCP), or ethylene-tetraflouroethylene (ETFE).

In Example 9, the subject matter of one or any combination of Examples 1-8 optionally includes a conductive layer that includes conductive tape wrapped around an outside surface of the elongate waveguide core.

In Example 10, the subject matter of one or any combination of Examples 1-9 optionally includes a conductive layer including a metal layer arranged around an outside surface of the elongate waveguide core.

In Example 11, the subject matter of one or any combination of Examples 1-10 optionally includes a width of a waveguide of the plurality of waveguides is less than two millimeters (2 mm) and the length of the waveguide is more than one meter (1 m).

In Example 12, the subject matter of one or any combination of Examples 1-11 optionally includes a waveguide transceiver circuit operatively coupled to the waveguide.

Example 13 can include subject matter (such as a method of making a waveguide), or can optionally be combined with one or any combination of Examples 1-12 to include such subject matter, comprising forming an elongate waveguide core using a dielectric material, wherein the waveguide core is formed to include at least one space arranged lengthwise along the waveguide core that is void of the dielectric material; and arranging a conductive layer around the waveguide core.

In Example 14, the subject matter of Example 13 optionally includes extruding a hollow tube of the dielectric material that includes a single space void of the dielectric material.

In Example 15, the subject matter or one or both of Examples 13 and 14 optionally includes injection molding multiple spaces in the dielectric material that are arranged lengthwise through the waveguide core and are void of the dielectric material.

In Example 16, the subject matter of one or any combination of Examples 13-15 optionally includes arranging a conductive layer around the waveguide core by wrapping the conductive tape around an outside surface of the waveguide core to form the conductive sheet.

In Example 17, the subject matter of one or any combination of Examples 13-16 optionally includes applying a liquid including a conductive material to an outside surface of the waveguide core to produce a conductive layer around the waveguide core, wherein the applying of the liquid includes one of: immersing the waveguide core into a container of the liquid including the conductive material, or drawing the waveguide core through the container of the liquid including the conductive material.

Example 18 includes subject matter (such as a system), or can optionally be combined with one or any combination of Examples 1-17 to include such subject matter, comprising a first server and a second server, wherein the first and second servers each include a plurality of ports; and a waveguide operatively coupled to a first port of the first server and a first port of the second server, wherein the waveguide includes an elongate waveguide core including a dielectric material, wherein the waveguide core includes at least one space arranged lengthwise along the waveguide core that is void of the dielectric material; and a metal layer arranged around the waveguide core.

In Example 19, the subject matter of Example 18 optionally includes the waveguide operatively coupled to the first port of the first server using a first waveguide transceiver circuit and a first waveguide launcher, and wherein the waveguide is operatively coupled to the first port of the second server using a second waveguide transceiver circuit and a second waveguide launcher.

In Example 20, the subject matter of one or both of Examples 18 and 19 optionally includes the elongate waveguide core including multiple spaces arranged lengthwise through the wave guide core that are void of the dielectric material.

These non-limiting examples can be combined in any permutation or combination.

The Abstract is provided to allow the reader to ascertain the nature and gist of the technical disclosure. It is submitted with the understanding that it will not be used to limit or interpret the scope or meaning of the claims. The following claims are hereby incorporated into the detailed description, with each claim standing on its own as a separate embodiment.

What is claimed is:

1. An apparatus comprises a waveguide including:

an elongate waveguide core including a dielectric material, wherein the elongate waveguide core includes multiple spaces arranged lengthwise within the elongate waveguide core and through the elongate waveguide core that are void of the dielectric material; and a conductive layer arranged around the elongate waveguide core, wherein the conductive layer includes a metal layer arranged around an outside surface of the elongate waveguide core.

2. The apparatus of claim 1, including a waveguide transceiver circuit operatively coupled to the waveguide.

3. The apparatus of claim 1, wherein a width of the waveguide is less than two millimeters (2 mm) and the length of the waveguide is more than one meter (1 m).

4. The apparatus of claim 1, wherein the multiple spaces arranged lengthwise through the wave guide core are arranged in a regular pattern to form a lattice cross section within the elongate waveguide core.

5. The apparatus of claim 1, wherein the elongate waveguide core includes a cross beam formed of the dielectric material arranged lengthwise along the waveguide core to define the multiple spaces void of dielectric material.

6. The apparatus of claim 1, wherein the elongate waveguide core includes an I-beam formed of the dielectric material arranged lengthwise along the waveguide core to define the multiple spaces void of dielectric material.

7. The apparatus of claim 1, wherein the dielectric material comprises twenty percent (20%) or less of a cross section of the elongate waveguide core and the multiple spaces void of dielectric material comprises eighty percent (80%) or more of the cross section of the elongate waveguide core.

8. The apparatus of claim 1, wherein the dielectric material includes at least one of polyethylene (PE), polytetrafluoroethylene (PTFE), perfluoroalkoxy alkanes (PFA), fluorinated ethylene propylene (FEP), polyvinylidene fluoride (PVDF), liquid crystal polymer (LCP), or ethylene-tetraflouroethylene (ETFE).

9. The apparatus of claim 1, wherein the metal layer includes tape wrapped around an outside surface of the elongate waveguide core.

10. A method of making a waveguide, the method comprising:

forming an elongate waveguide core using a dielectric material, wherein the elongate waveguide core is formed to include multiple spaces arranged lengthwise along the elongate waveguide core that are void of the dielectric material; and arranging a conductive layer around the elongate waveguide core including wrapping conductive tape around an outside surface of the elongate waveguide core to form a conductive sheet.

11. The method of claim 10, wherein forming the elongate waveguide core to include the multiple spaces includes injection molding multiple spaces in the dielectric material that are arranged lengthwise through the elongate waveguide core and are void of the dielectric material.

12. A system comprising:

a first server and a second server, wherein the first and second servers each include a first port among a plurality of ports; and a waveguide operatively coupled to the first port of the first server and the first port of the second server, wherein the waveguide includes an elongate waveguide core including a dielectric material, wherein the elongate waveguide core includes multiple spaces arranged lengthwise within the elongate waveguide core and through the elongate waveguide core that are void of the dielectric material; and a metal layer arranged around an outside surface of the elongate waveguide core.

13. The system of claim 12, wherein the waveguide is operatively coupled to the first port of the first server using a first waveguide transceiver circuit and a first waveguide launcher, and wherein the waveguide is operatively coupled to the first port of the second server using a second waveguide transceiver circuit and a second waveguide launcher.

* * * * *